US006290057B1

(12) United States Patent
Hurley

(10) Patent No.: US 6,290,057 B1
(45) Date of Patent: Sep. 18, 2001

(54) BOTTLE SHIPPER

(75) Inventor: Richard B. Hurley, Corvallis, OR (US)

(73) Assignee: Western Pulp Products Co., Corvallis, OR (US)

( * ) Notice: Subject to any disclaimer, the term of this patent is extended or adjusted under 35 U.S.C. 154(b) by 0 days.

(21) Appl. No.: 09/393,015

(22) Filed: Sep. 10, 1999

(51) Int. Cl.[7] ..... B65D 75/00
(52) U.S. Cl. ..... 206/203; 206/592
(58) Field of Search ..... 206/203, 433, 206/589, 588, 592; 220/516, 517

(56) References Cited

U.S. PATENT DOCUMENTS

| | | | | |
|---|---|---|---|---|
| D. 155,932 | | 11/1949 | Shepard . | |
| D. 157,540 | * | 2/1950 | Shepard | 206/592 |
| D. 160,738 | | 10/1950 | Randall . | |
| D. 290,580 | | 6/1987 | Vigue . | |
| 1,876,063 | | 9/1932 | Kronenberger . | |
| 1,960,279 | | 5/1934 | Read . | |
| 1,967,026 | | 7/1934 | Gray et al. . | |
| 2,783,879 | | 3/1957 | Emery . | |
| 2,863,595 | | 12/1958 | Emery . | |
| 2,936,922 | | 5/1960 | Williams . | |
| 3,261,531 | | 7/1966 | Barth . | |
| 3,286,833 | | 11/1966 | Chadbourne . | |
| 3,608,706 | | 9/1971 | Vigue . | |
| 3,715,853 | | 2/1973 | Bemiss . | |
| 3,732,976 | | 5/1973 | Bessett et al. . | |
| 3,961,708 | * | 6/1976 | Von Dohlen et al. | 206/433 |
| 4,037,722 | * | 7/1977 | Bremer | 206/592 |
| 4,241,830 | | 12/1980 | Di Gesu . | |
| 4,298,156 | | 11/1981 | Reifers et al. . | |
| 4,427,730 | | 1/1984 | Robbins et al. . | |
| 4,792,045 | | 12/1988 | Creaden . | |
| 4,840,276 | | 6/1989 | George . | |
| 4,911,300 | | 3/1990 | Colonna . | |
| 5,096,650 | | 3/1992 | Renna . | |
| 5,127,526 | | 7/1992 | Vigue . | |
| 5,259,508 | | 11/1993 | Beckerman . | |
| 5,335,770 | | 8/1994 | Baker et al. . | |
| 5,645,169 | * | 7/1997 | Dull et al. | 206/589 |
| 5,806,683 | * | 9/1998 | Gale | 206/592 |
| 5,816,409 | * | 10/1998 | Baker et al. | 206/587 |
| 5,938,011 | * | 8/1999 | Holzapfel et al. | 206/203 |
| 6,042,000 | * | 10/1998 | Kawamoto | 229/406 |

FOREIGN PATENT DOCUMENTS

| | | |
|---|---|---|
| 1205747 | 2/1960 | (FR) . |
| 2155005 | 5/1973 | (FR) . |
| 857011 | 12/1960 | (GB) . |
| 870704 | 6/1961 | (GB) . |
| 596274 | 7/1959 | (IT) . |
| 624839 | 9/1961 | (IT) . |

* cited by examiner

*Primary Examiner*—David T. Fidei
(74) *Attorney, Agent, or Firm*—Dellett and Walters

(57) ABSTRACT

A bottle shipping structure made of molded fiber having two tray portions. The first portion is folded along a hinge line, and placed within a carton, defining multiple bottle receiving portions for engaging the bottle heel portions, maintaining the bottles in spaced positions away from the bottom and sides of the trays, as well as maintaining the bottles in spaced relation to each other. The second portion is folded along a hinge line and placed within the carton, over the top, neck ends of the bottles. Neck engaging finger members grab the bottle necks and limit movement thereof. Centrally within the bottle receiving portions, the bottles are held spaced away from contact with the tray portions, to prevent the likelihood of the bottle labels from becoming damaged by abrasion.

24 Claims, 6 Drawing Sheets

BOTTLE SHIPPER

BACKGROUND OF THE INVENTION

This invention relates to protective shipping materials, and more particularly for a protective shipper for bottles, such as wine bottles.

In the wine industry, shipping of bottles of wine is an issue. In order to minimize cost, it is important to reduce the amount of time needed to pack a 12 bottle case of wine for shipping. Currently, primarily foam shipping protectors are employed, which comprise two (typically) blocks of foam that fit together, the interior thereof defining receiving zones for the wine bottles.

However, the foam packaging takes up a great deal of space, as it cannot be shrunk or nested together for shipping or storage prior to use. Many wine sellers are retail establishments, where space is at a premium. To store a large number of foam shippers becomes expensive, as the space to store shipping materials prior to use would be better used for display of revenue producing products or for storage of higher value items. Further, foam is perceived as environmentally unfriendly, and recycling of foam is not widespread.

The aesthetic appearance of a wine bottle is important to the consumer and retailer. If the labeling on the bottle is abraded or otherwise scraped or damaged during shipping, then the value of the bottle, or its perceived value, is reduced. It is therefore important that the packaging materials employed during shipping provide protection against breakage of the bottles, while not resulting in abrasion or damage to the bottle labels.

SUMMARY OF THE INVENTION

In accordance with the invention, a bottle shipping protector has an upper and lower tray. The trays are suitably made of molded fiber, each of the upper and lower trays folding together to define a three dimensional shipping structure. The tray portions engage the bottle at the heel and neck thereof, leaving the label portion free from contact with any structure.

Accordingly, it is an object of the present invention to provide an improved bottle shipping protector that is easily and quickly assembled.

It is a further object of the present invention to provide an improved wine bottle shipping protector that minimizes contact with the bottle label.

It is yet another object of the present invention to provide an improved bottle shipper that will accommodate a variety of bottle sizes with a single protector assembly.

A further object of the present invention to provide an improved bottle shipper that is recyclable.

Another object of the present invention is to provide an improved shipping system that minimizes the space required for storage, prior to use in shipping.

Yet another object of the present invention is to provide an improved wine bottle shipping protector with a 3 dimensional shock absorbing zone around a bottle.

Still a further object of the invention is to provide an improved molded fiber shipping protector having a tall three dimensional profile.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present invention comprises a bottle shipping protector adapted for upright shipping of twelve bottles. In the preferred embodiment, the bottles are wine bottles.

Figure 1:
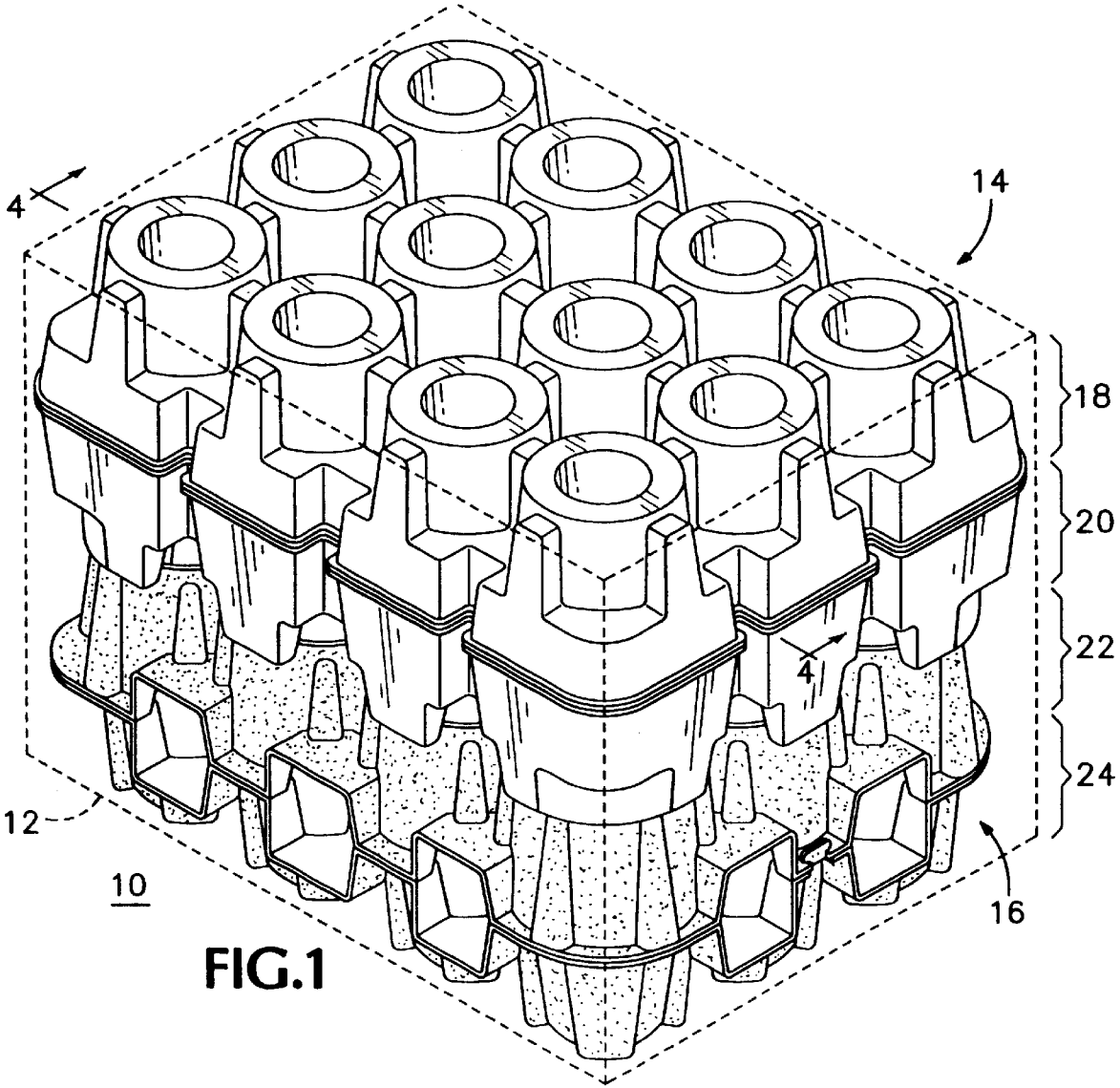
FIG. 1 is a perspective view of the upright bottle shipper according to the present invention.

Referring now to FIG. 1, a perspective view of the upright bottle shipper according to the present invention, the shipper 10 generally defines a rectangular block adapted to fit within a shipping box 12 (illustrated in phantom in FIG. 1). An upper tray 14 sits atop a bottom tray 16, the upper tray comprising a top portion 18 and a bottom portion 20. The bottom tray similarly comprises an upper portion 22 and a lower portion 24. The trays together define four layers, lower portion 24 being layer one, upper portion 22 being layer two, bottom portion 20 being layer three and layer four being top portion 18. Contained within the interior of these upper and bottom trays are bottles which are to be shipped. The various structures of the trays as described hereinbelow cooperate to provide a three dimensional zone to protect the bottles from damage during shipment and to protect the bottle labels from being abraded by contact with the shipping protector trays or other items.

Figure 2:
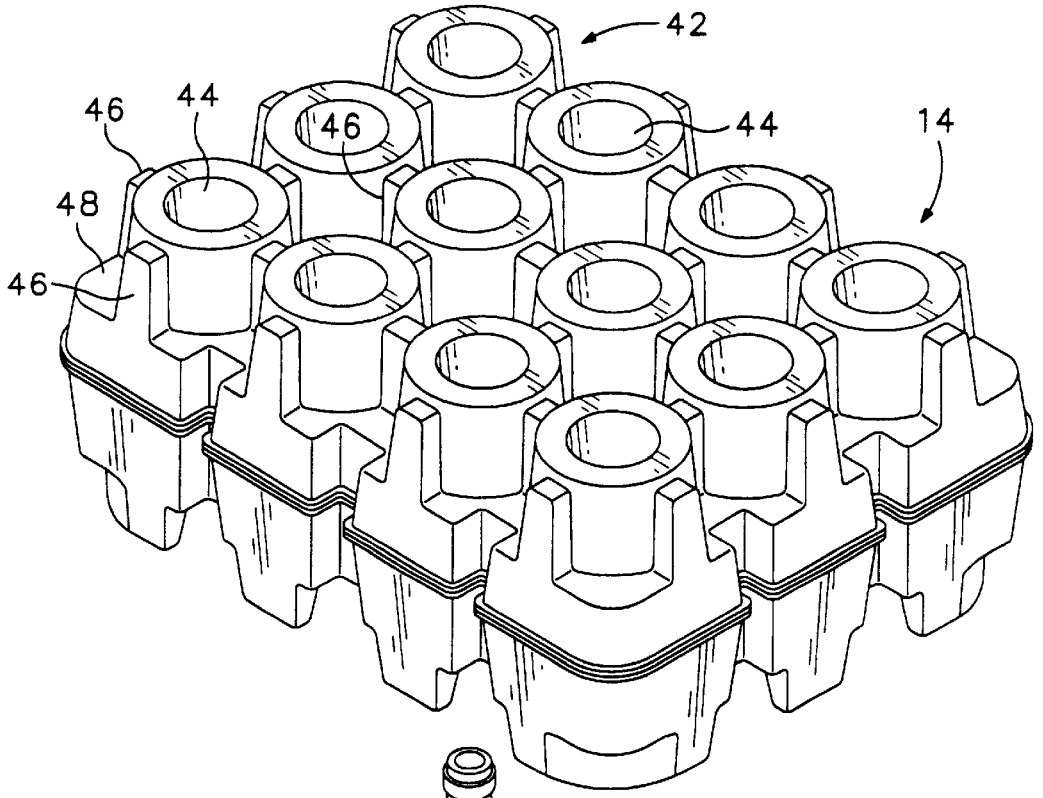
FIG. 2 is a perspective view of the upright bottle shipper according to the present invention with the top half removed, illustrating placement of bottles therein.
Figure 2:
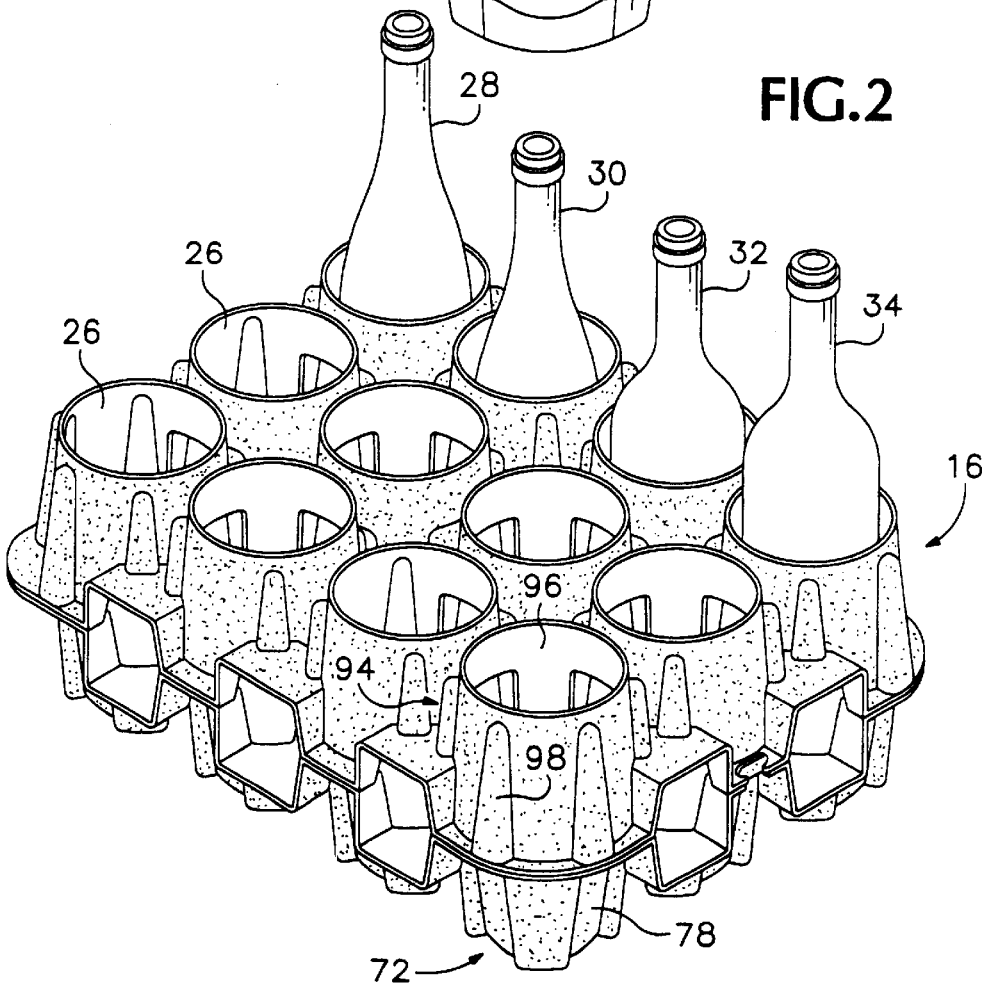

Referring now to FIG. 2, a perspective view of the upright bottle shipper according to the present invention with the top tray removed, illustrating placement of bottles therein, the bottom tray has plural bottle receiving openings 26 defined therein, in a regular spaced arrangement. In the illustrated embodiment, there are twelve such openings 26, defined in four by three matrix. As detailed further herein below, wine bottles 28, 30, 32 and 34 are received by the lower tray portion and extend upwardly through the openings 26. The upper tray 14 has bottle receiving features therein, so as to cooperate with and secure the bottles when the upper tray is lowered over the bottles and onto the top of the bottom tray.

Figure 5:
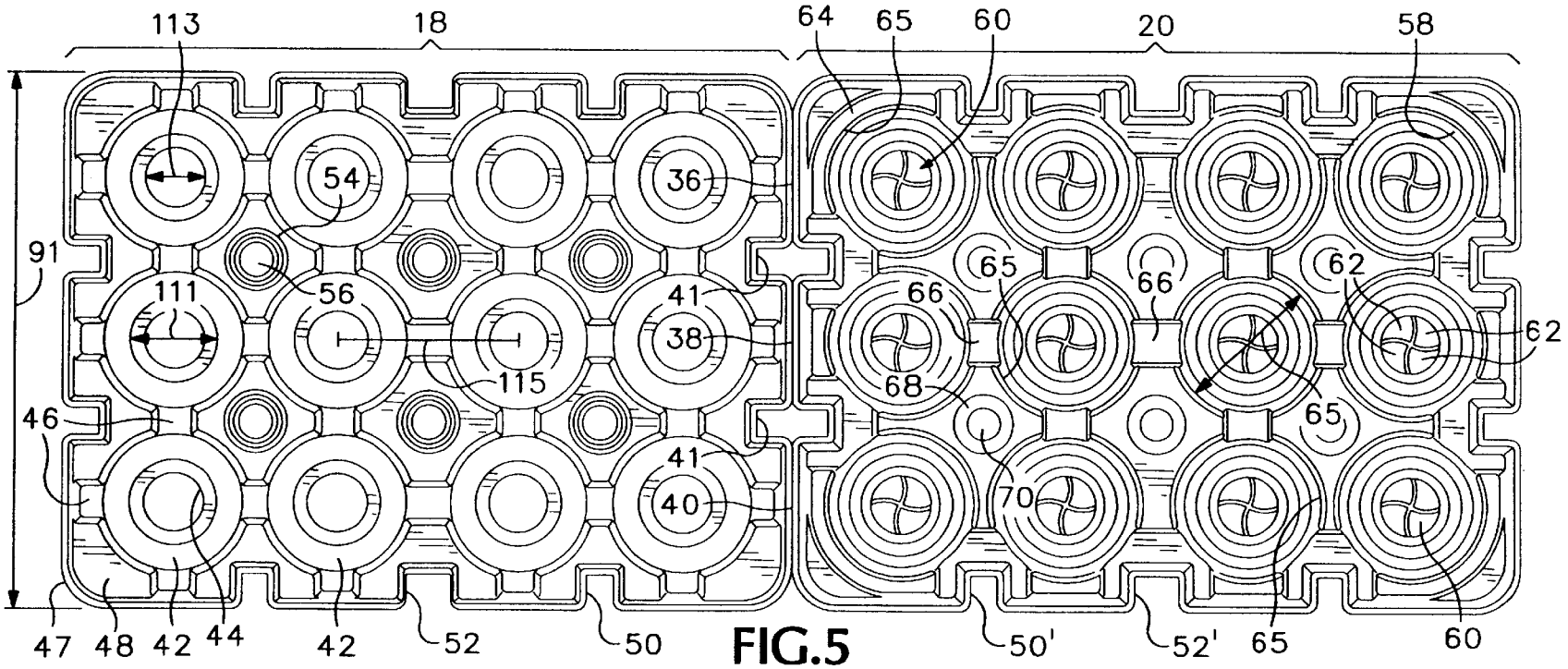
FIG. 5 is a top view of the top tray of the bottle shipper.
Figure 6:
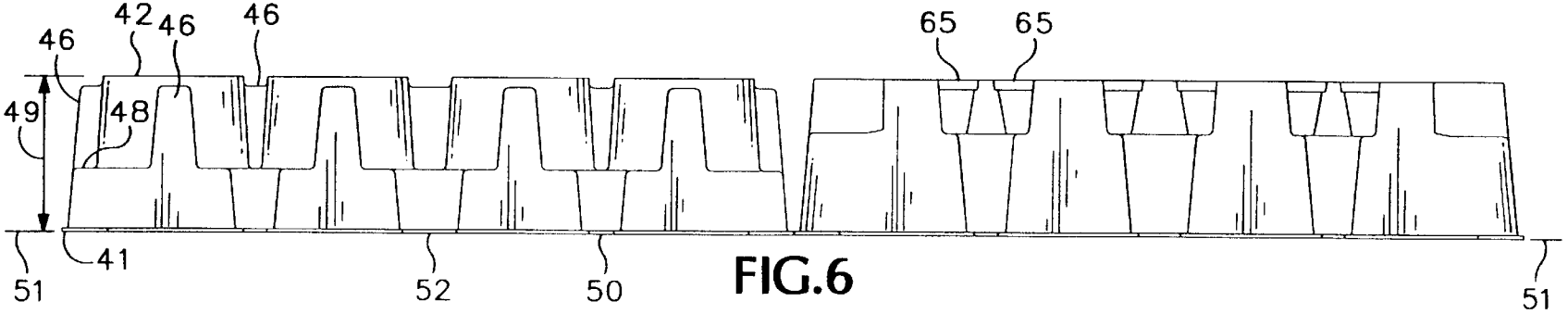
FIG. 6 is a side view of the top tray of the bottle shipper.

Referring now to FIG. 5, a top view of the top tray of the bottle shipper and to FIG. 6, a side view of the top tray of the bottle shipper, both views with the tray in an unfolded state, the upper portion 18 (layer four) and lower portion 20 (layer three) of the tray are suitably rectangular when considering the overall foot print defined by their respective perimeters. The right shorter edge of the upper tray is hingedly connected to the left shorter edge of the lower tray.

Three joined hinging regions 36, 38 and 40 are provided, with substantially right angular cut-outs 41 defined at either side of the central hinging region 38. Suitably, these cut-outs extend inwardly from the perimeter of their respective tray edges approximately 1 inch.

The upper tray comprises twelve spaced cylindrical members 42, which flare outwardly slightly in the downward direction. An opening 44 is centrally defined within the member 42, forming a well into the internal cavity formed by the cylinder.

Spaced regularly about the cylindrical member, suitably at 90 degree intervals, are reinforcement members 46 which are flared block shaped members, extending from a position just below the top of the cylinder member down to a level approximately two thirds the overall depth 49 of the tray. Those reinforcement members that are positioned between two adjacent cylindrical members form a joining bridge between the adjacent cylindrical members. At the two thirds depth, a perimeter 48 is formed, extending outwardly, and then downwardly to a perimeter skirt 47, to define the peripheral extent of the tray.

Positioned about the perimeter of the tray, defined between adjacent cylindrical members 42, are inward step areas 50 and 52, which define interruptions in the perimeter skirt. Steps 50 are slightly narrower than steps 52, the steps 52 being positioned at the tray center along the longer edges of the tray.

Positioned centrally of any four cylinder members are downwardly oriented pillar members 54, the floor 56 of these pillar members being at the lower most planar level 51 defined by the tray.

Considering now the lower half 20 of the tray (level three), corresponding to regions 50 and 52, are stepped in regions 50' and 52', along the longer edges of this half of the tray. Twelve concave up regions 58 are defined in the tray portion, corresponding in location to the cylindrical members 42. Around at least portions of the openings into the regions 58 are seat portions 65, defining a peripheral seat that is positioned inwardly about one quarter of an inch from the top of the opening into the regions. At the bottom of each region 58 is a web 60, which somewhat closes off the bottom of region 58 to define a floor. A "wavy" criss-cross score region is provided in the web, typically being scored all the way through the web to provide tab members 62. In the illustrated embodiment, these scores comprise overlapping stretched "S" shapes. At each corner of this tray portion, an upper curved perimeter 64 is defined, around approximately a 90 degree arc of the corner regions. Between any two adjacent regions 58, connecting reinforcement members 66 are provided to join the two regions 58. Centrally between any four regions 58 are downwardly extending pillars 68, which extend down to the lowest planar level 51 of the tray and which have a flat floor 70 at the bottom thereof. Suitably, the pillars are slightly tapered to form a frusto-conical shape, with the narrowest portion being at the base at planar level 51.

Figure 7:
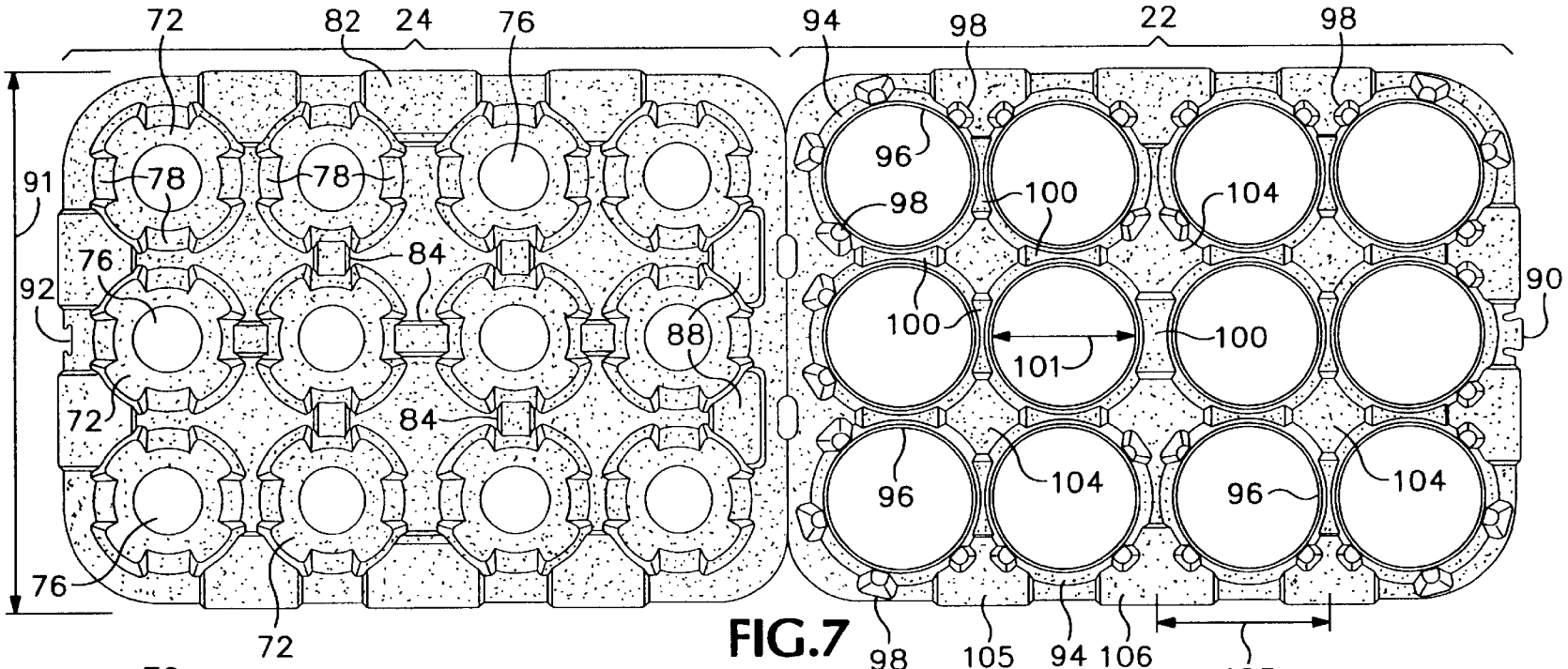
FIG. 7 is a top view of the bottom tray of the bottle shipper.
Figure 8:
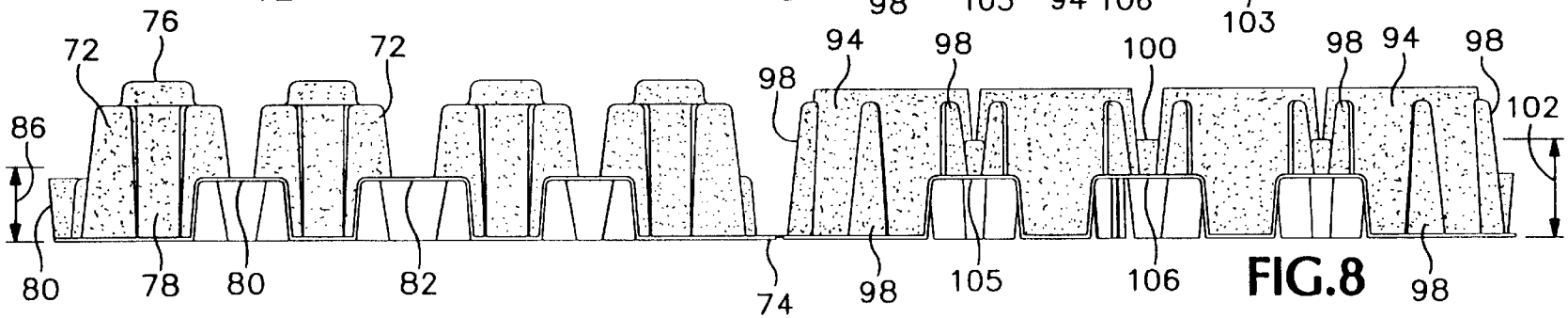
FIG. 8 is a side view of the bottom tray of the bottle shipper.

Referring now to FIG. 7, a top view of the bottom tray of the bottle shipper and to FIG. 8, a side view of the bottom tray of the bottle shipper, bottom half 24 of the bottom tray 16 comprises twelve spaced bottle receiving cone members 72, the cone members extending upwardly from the peripheral web or floor 74 of the tray, tapering slightly to be narrower at the top closed end than at its end at the tray floor. An impact cushion dish 76 is positioned at the top of each the member 72, the dish being narrower in diameter than the rest of the cone. Each member 72 has a set of four inwardly stepped ribs 78 defined on the outside thereof, extending substantially the extent of the vertical height of the cone members, but tapered so that a given rib 78 has the greatest inward step at the closed end of the cone shaped member. Along the edge of the peripheral web 74, between any two adjacent cone member 72 is an upwardly extending interruption step region 80, a somewhat longer such region 82 being positioned at the center of the longer edge of the tray, between the center edge cone members. Regions 80 and 82 have height 86 (FIG. 8) that is approximately one third of the total height of the height of this half of the tray. Along three sides of the tray half, the step regions extend to the peripheral edge of the tray, resulting in an opening visible in the side view. However note that along the edge of the tray half that is shared with the other half of the tray, the corresponding step regions 88 are closed. Between adjacent cone members in the center of the tray (that is, those cones or the sides of the cones not at the periphery of the tray) a bridge member 84 extends between the neighboring cone members. The height of the bridge members corresponds to the height 86 of the step regions 80, 82.

Referring now to the right halves of FIG. 7 and FIG. 8, the "top" half of the bottom tray is hingedly connected with the bottom half (in a corresponding manner to the hinged connection of the upper tray portions of FIG. 5 and FIG. 6). A dove tail 90 is defined at the right most edge of the peripheral edge of the tray portion, with a corresponding key slot 92 defined in the far edge of the other half of this tray portion. Plural relatively large cone members 94 having opening 96 at the tops thereof, are arranged in a corresponding pattern to the cone members 72 of the other tray portion. Tapered ribs 98 are defined along the walls of the various cone members 94, for structural strength thereof. Most of the tapered ribs are on the cone portions along the periphery of the tray half. Adjacent cone members are joined at bridge portions 100, suitably positioned at a height 102 from the bottom edge of the tray's peripheral web. Again, as in the other tray portions, stepped regions 105 and 106 are provided, extending about one third the height of the tray half. Regions 104 are floor web portions, being the height of the peripheral floor web.

In the preferred embodiment, the upper and bottom tray portions are made from molded paper, wherein paper is pulped and molded to the desired shapes, and then dried in ovens. The molds are typically constructed of screens, which are dipped into a vat of the pulp mixture, and pulp is sucked against the screen faces. Then the mold is removed from the pulp vat. The pulp that has been sucked to the mold remains, and a pick off mold, having a complementary shape, is placed against the screen mold, to pull the molded article off the screen mold, for drying. The resulting article typically has a smoother face, the face that was against the screen mold having a profile matching the mold, and a rougher face having a corresponding backside profile. The faces of the upper tray that are mostly viewable in FIG. 5 and FIG. 6 are the smoother faces, while the faces of the bottom tray mostly viewable in FIG. 7 and FIG. 8 are the rougher faces. The advantages of this configuration are discussed hereinbelow. The opposite faces of the tray portions have corresponding inverse structures, wherein, for example, a concave down region on one face defines a concave up region when considered from the other face.

To use the tray for shipping bottles such as wine bottles, a box is selected having a size to receive the trays therein. The bottom tray portion is then selected by a packer, and folded over along the hinged region of the two halves, so that the smoother sides of the tray halves come together, leaving the rougher sides out. Dovetail 90 is folded into key slot 92, to maintain the tray portions in the folded configuration. Now, the folded over tray portion is placed inside the shipping box, with the impact cushion disks 76 oriented downwardly, towards the bottom of the box. Referring now to FIG. 2, the resulting folded over tray bottom is as shown at the bottom of FIG. 2, wherein the box is removed for clarity of illustration. The twelve openings are for receiving bottles, so the packer will now insert bottles into each of the openings. In FIG. 2, four such bottles are inserted, each bottle having a slightly different configuration, to illustrate a subset of the variety of bottle types that can be accommodated by the bottle shipper. Once the twelve bottle receiving positions have had bottles placed therein, then the packer selects an upper tray portion, and folds it in half along its hinge line. The upper tray portion is folded such that the smoother faces are not oriented towards each other, but rather, the rougher faces are placed to each other, resulting in the smoother faces being visible from the outside of the tray. The upper tray portion is then lowered onto the top of the bottles, and the box is sealed with the wine bottles and the shipping protector therewithin. The smooth-side-out orientation of the upper tray provides a more pleasing visual presentation to the consumer on opening of the lid of the carton upon receipt of the package. Also, as noted below in connection with FIG. 4, the smooth sides of the tab members 62 on level three (tray portion 20) of the shipping structure contact the bottle neck. Therefore, all of the contact positions of the shipping tray portions to the bottles, at level 1 and level 3, are the relatively smooth sides of the trays.

Figure 4:
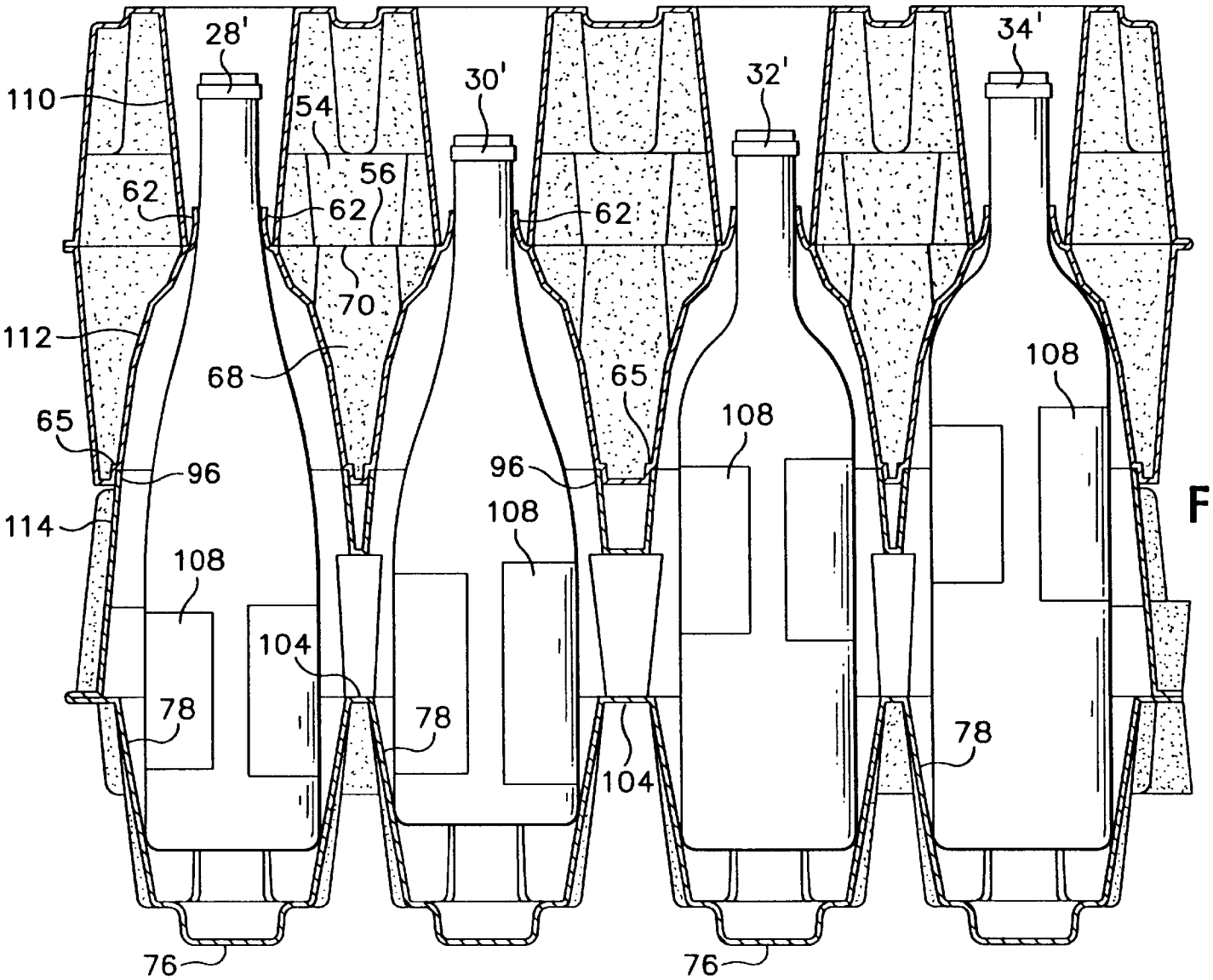
FIG. 4 is a sectional view of the bottle shipper according to the present invention, taken along line 44 of FIG. 1.

Referring to FIG. 4, a sectional view of the bottle shipper according to the present invention, taken along line 4—4 of FIG. 1, the engagement of the bottles 28', 30', 32' and 34' with the shipping protector may be observed. The bottom portions of the bottles are received within the tapering lower cone, and are engaged by the internal faces of the ribs 78. The height above the disk portion 76 at which the bottle will rest is a factor of the bottle diameter. Larger diameter bottles (which typically, are also shorter) will sit higher (see, e.g. bottle 30') than a more narrow bottle (see, e.g. bottle 34'). Since the bottles in the particular embodiment are wine bottles, having a 750 ml capacity, larger diameters bottles are shorter, while the narrower bottles are longer. The variable height of the seating position in the tray ensures that the upper ends of the bottles are held at approximately the same height relative to each other, resulting in engagement of the bottle necks by the tab members 62. The tab members are bent upwardly by the bottle passing through the slit portion therebetween, and act to hold the bottle against movement. The bottles are also engaged by the shipping protector at the heel or bottom portions of the bottles, leaving the label portions 108 free from contact with the protector. The labels are thereby preserved and are not scuffed, scraped, or otherwise abraded, which would detract from the appearance of the bottle. Abraded labels are not desired by consumers, as the aesthetic appearance of the bottle at time of purchase or time of serving is important. The value of a bottle can be reduced by a damaged label, even though the wine within the bottle is not damaged. The structure of the shipping protector according to the invention is such that the first, second, third and fourth layers present the smoother sides inwardly to the bottle. Certain bottle configurations, such as bottle 34' in FIG. 4, will be engaged at the bottle neck by the tab members 62 and also at the bottle shoulder region by shoulder engaging wall 112. Therefore, even if there is contact with the shipping protector and the bottle label or any other portion of the bottle, the contact is with the smoother portions of the shipping protector, minimizing any abrasion that might occur. The top most layer also presents the smoother side out, so that when the carton is first opened by a consumer, the presentation is of the smoother side, giving a more enhanced appearance to the overall packaging.

To prevent the bottles from rocking or shifting laterally within the protector, the upper necks of the bottles pass through the crisscross scores, bending the tabs 62 upwardly. The four tab members engage the respective bottle neck, providing a snug fit against bottle movement. It will also be observed in FIG. 4, that the corresponding regions 104 from tray portion 22 and tray portion 24 meet, providing a vertical support column. Similarly, the upper tray portions pillar members 54 and 68 seat against each other at floors 56 and 70, providing vertical support pillars through the assembled shipping protector between any four adjacent bottle receiving portions. These vertical supports enable stacking of multiple filled cartons of wine bottles, without the weight being born directly onto the top and bottom of the bottles. This structure also provides vertical impact survivability to the shipping protector. Referring to FIG. 4, it may be observed that vertical support is further provided when the trays are folded and assembled, by the cooperation of wall portions 110, 112 and 114, as well as 78. These items in cooperation form a shell around the bottle, transferring vertical force loading.

Figure 3:
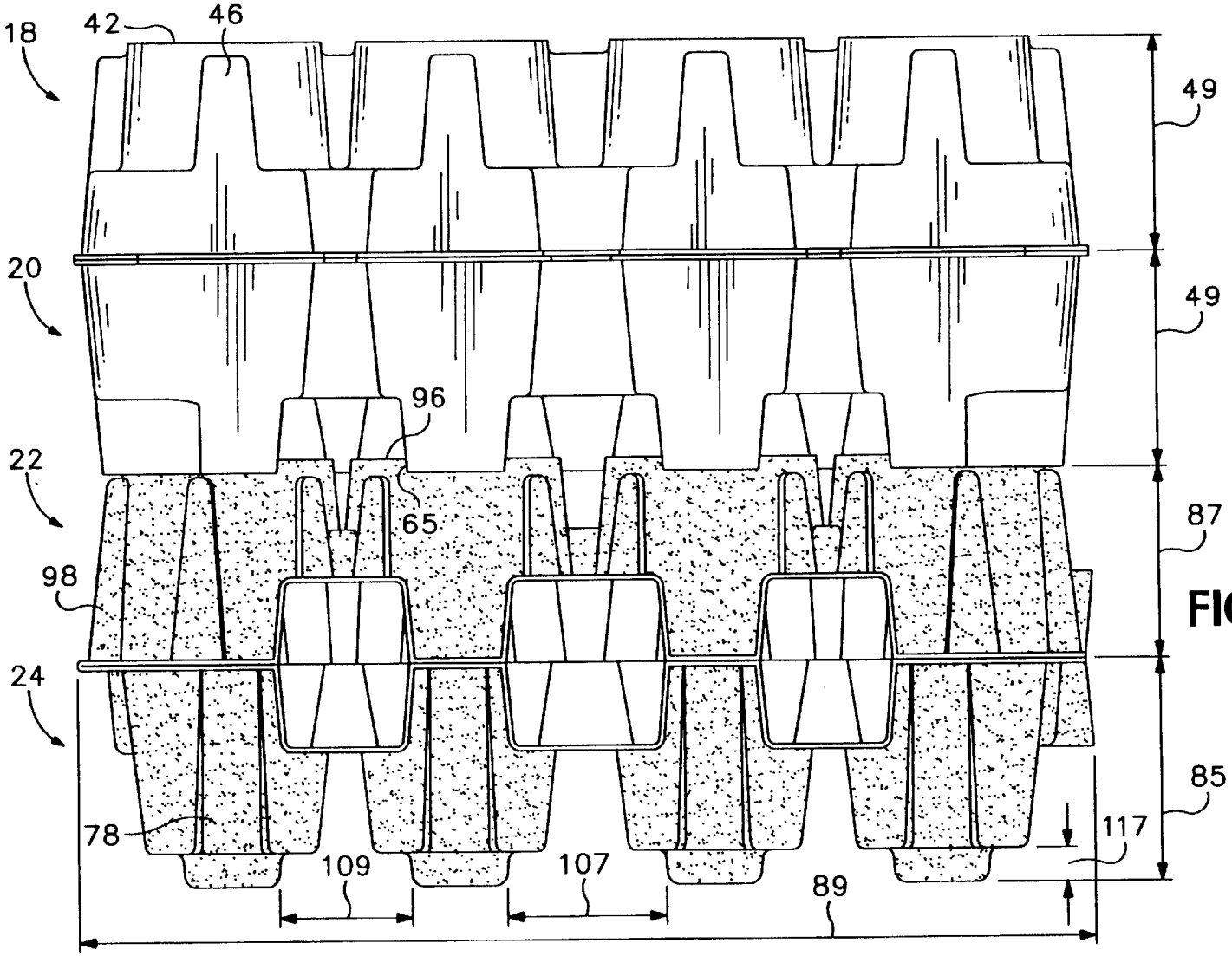
FIG. 3 is a side view of the bottle shipper in assembled form.

It may also be observed that the seat portions 65 in the upper tray are suitably sized to mate with the peripheral rims of openings 96 of the bottom tray, so the upper and lower tray portions seat together and are not prone become misaligned (see also, FIG. 3). The seat also assists in quick proper positioning of the upper tray onto the lower tray when packing a carton.

The bottom bottle receiving portion of the tray therefore defines a crushable geometry to seat the bottle, low on the heel bottle, away from the label, with a hollow void filling section that maintains the bottle label untouched. The upper end of the bottle neck is also engaged by the tray, holding the bottle but not touching the label which is lower on the main bottle body.

The impact cushion dish provides an impact cushion region, while bridge members provide a reinforcement to prevent the bottle receiving cone members 72 from collapsing towards each other on impact. The vertical and horizontal shape variations of the tray portions provide impact cushioning and absorbing features, for reducing the chance of breakage during shipping.

In the illustrated embodiment, dimensions of the shipping protector are as follows: The height 49 of tray portions 18 and 20 (layer four and layer three) is 3.75 inches. The height 85 (FIG. 3) of tray portion 24 (layer one) is 4.0 inches, while tray portion 22 (layer two) is 3.75 inches high (reference number 87). The longer side length 89 of any of the tray sections is 18 inches, while the shorter side widths 91 of the tray sections is 14 inches. The diameter 101 of opening 96 is 3.75 inches, while the diameter 103 defined at the base of the opening (at the base of the cone members 94) is 4.25 inches. The height 117 (FIG. 3) of the impact cushion disks 76 is ⅝ inch. The width 107 of portions 82 is 3 inches (at the widest extent) while portions 80 are 2.5 inches wide at 109 (2.25 at the narrower ends). The diameter 111 of the opening 44 is 2⅛ inches, while the diameter at the bottom thereof at 113 is 1.5 inches. The center to center spacing 115 of adjacent bottle cells is 4.25 inches. Seat portions 65 have an inner diameter of 3⅞ inches so as to cooperatively mate with the corresponding portions 96. The dimensions given are particularly adapted for 750 ml capacity wine bottles, but these dimensions may be suitably modified, to accommodate different sized bottles or other articles.

Accordingly, a bottle protector for shipping bottles is provided. The bottles are shipped in an upright configuration, but the bottles are not weight bearing as would be the case in a typical prior art wine bottle case with only bottles and a corrugated container configuration. The protector is made from a recycled/recyclable material (suitably molded paper fiber), and the tray components nest for more economical shipping and storage prior to use. A variety of bottle shapes and sizes are accommodated. For example, champagne style bottles are also suitably received by the protector.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A container packaging system for holding a plurality of bottles therein comprising:

a first molded fiber bottle engager for engaging primarily a bottom region of at least one of said plurality of bottles, said first molded fiber bottle engager having a widening taper, being narrower at a bottom most bottle engaging portion thereof, said first molded fiber bottle engager further including a second portion having a narrowing taper;

a second molded fiber bottle engager for engaging primarily a top region of at least one of said plurality of bottles, said second molded fiber bottle engager having a first narrowing tapered portion, being wider in lower portions relative to a one of said plurality of bottles, and a second portion having a widening taper in lower portions relative to a one of said plurality of bottles;

wherein said first and second molded fiber bottle engagers cooperatively mate with each other for maintaining the relative spatial orientation thereof to maintain the at least one bottle in a selected orientation with the weight of the bottle supported by the bottom region of the bottle.

2. A container packaging system for holding a plurality of bottles therein according to claim 1 wherein at least one of said first and second bottle engagers has a height greater than 50% of a height of a selected one of said plurality of bottles.

3. A container packaging system for holding a plurality of bottles therein according to claim 1 wherein both of said first and second bottle engagers each have a height greater than 50% of a height of a selected one of said plurality of bottles.

4. A container packaging system according to claim 1, wherein said first molded fiber bottle engager comprises a tray having a bottle bottom receiving depression therein, said depression having plural tapered raised portions in spaced relation for capturing and wedging the bottle bottom therein.

5. A container packaging system according to claim 1, wherein said second molded fiber bottle engager comprises a tray having a bottle neck receiving aperture therein, said aperture having plural deformable engaging members in spaced relation for enabling the bottle neck to pass therethrough, but capturing and wedging the bottle neck therebetween.

6. A container packaging system according to claim 1, wherein said first molded fiber bottle engager comprises a tray having at least one extending pillar member thereon and wherein said second molded fiber bottle engager comprises a tray having at least one extending pillar member thereon, said first and second tray pillar members cooperating for providing vertical load support between the tray portions.

7. A container packaging system according to claim 1, wherein said first molded fiber bottle engager comprises a tray having a seat portion defined thereon and wherein said second molded fiber bottle engager comprises a tray having a corresponding seat portion defined thereon, wherein said first tray and said second tray seat portions are adapted for seating together to assure proper orientation thereof.

8. A container packaging system for holding a plurality of bottles therein comprising:

a first molded fiber bottle engager for engaging primarily a bottom region of at least one of said plurality of bottles;

a second molded fiber bottle engager for engaging primarily a top region of at least one of said plurality of bottles;

wherein said first and second molded fiber bottle engagers cooperatively mate with each other for maintaining the relative spatial orientation thereof to maintain the at least one bottle in a selected orientation with the weight of the bottle supported by the bottom region of the bottle, wherein said first molded fiber bottle engager comprises a tray having first and second layers, said first and second layers adapted to fit together for defining the bottle engaging portion that engages the bottle bottom, and for defining a bottle pass through portion that substantially does not engage the bottle but transfers load, said bottle pass through portion defining a seat thereon, and wherein said second molded fiber bottle engager comprises a tray having first and second layers, said first and second layers adapted to fit together for defining the bottle neck engaging portion.

9. A container packaging system according to claim 8 wherein said first and second layers of said first molded fiber bottle engager are hingedly connected and fit together by folding said first and second layers along said hinged connection.

10. A container packaging system according to claim 8 wherein said first and second layers of said second molded fiber bottle engager are hingedly connected and fit together by folding said first and second layers along said hinged connection.

11. A container packaging system according to claim 8 wherein said first engager maintains a bottle positioned therein in spaced relation to a bottom level, for providing protection against impact to the bottle.

12. A container packaging system according to claim 8 wherein said second engager maintains a bottle positioned therein in relatively fixed position against lateral movement.

13. A container packaging system according to claim 1 wherein said first engager and second engager maintain a bottle positioned therein in suspended relation spaced from x, y and z axis perimeters of said engagers, for providing protection against impact to the bottle when said engagers and said bottle are placed within a container.

14. A container packaging system according to claim 1 wherein portions of said first and second engagers define load transmitting portions, for distributing loading through the packaging system without transferring weight bearing loading to the bottles.

15. A shipping protector comprising:

a first tray member, said tray member having a first and a second portion, wherein said first and second portions are hingedly connected and adapted for folding along the hinged connection for defining a first three dimensional structure with plural article receiving portions therein for receiving first ends of elongate articles therein;

a second tray member, said second tray member having a first and a second portion, wherein said first and second portions are hingedly connected and adapted for folding along the hinged connection for defining a second three dimensional structure with plural article receiving portions therein for receiving second ends of elongate articles therein;

wherein said first and second three dimensional structures cooperatively engage one another to contain articles therewithin in spaced relation away from peripheries of said first and second structures.

16. A shipping protector according to claim 15 wherein at least one of said first and second tray portions has a height greater than 50% of a height of a selected elongate article.

17. A shipping protector according to claim 15 wherein said first and second tray portions each have a height greater than 50% of a height of a selected elongate article.

18. A shipping protector according to claim 15, wherein said first and second tray members comprise molded fiber.

19. A shipping protector according to claim 18, wherein said first tray member has relatively smooth and relatively rough sides, respectively, wherein said first tray member folds along said hinged connection so that the relatively smooth faces thereof face together, for presenting a smoother face to the article contained therewithin.

20. A shipping protector according to claim 18, wherein said second tray member has relatively smooth and relatively rough sides, respectively, wherein said second tray member folds along said hinged connection so that the relatively smooth faces thereof face outwardly, for presenting a smoother face to an upward direction for enhanced presentation within a shipping enclosure, while also presenting a smoother face to the article.

21. The shipping protector according to claim 18, wherein the articles comprises wine bottles and wherein said first three dimensional structure is substantially free of engagement with said articles other than at heel ends thereof.

22. The shipping protector according to claim 18, wherein the articles comprises wine bottles and wherein said second three dimensional structure is substantially free of engagement with said articles other than at neck and/or shoulder portions thereof.

23. A container packaging system according to claim 1 wherein when said first and second molded fiber bottle engagers are cooperatively mated, said second portion of said first engager is positioned adjacent said first portion of said first engager, said first portion of said second engager is adjacent said second portion of said first engager, and said second portion of said second engager is adjacent said first portion of said second engager.

24. A shipping protector according to claim 18, wherein said second tray member has relatively smooth and relatively rough sides, respectively, wherein said second tray member folds along said hinged connection so that the relatively smooth faces thereof face outwardly, for presenting a smoother face to the exterior.

* * * * *